US006324697B1

(12) United States Patent
Shofner

(10) Patent No.: US 6,324,697 B1
(45) Date of Patent: Dec. 4, 2001

(54) STUDENT'S BOOK CARRYING DEVICE

(76) Inventor: William K. Shofner, 1024 Ponderosa Rd., Venice, FL (US) 34293

( * ) Notice: Subject to any disclaimer, the term of this patent is extended or adjusted under 35 U.S.C. 154(b) by 0 days.

(21) Appl. No.: 09/783,482

(22) Filed: Feb. 14, 2001

(51) Int. Cl.[7] ..... A41D 1/04
(52) U.S. Cl. ..... 2/102
(58) Field of Search ..... 2/102, 247, 108, 2/94, 69, 2.5

(56) References Cited

U.S. PATENT DOCUMENTS

| | | | | |
|---|---|---|---|---|
| D. 403,836 | | 1/1999 | Len . | |
| 2,248,455 | | 7/1941 | Fruend . | |
| 2,304,574 | | 12/1942 | Kirschenbaum . | |
| 2,620,479 | | 12/1952 | Buck . | |
| 2,970,316 | | 2/1961 | Silin . | |
| 4,068,314 | | 1/1978 | Yellen et al. . | |
| 4,241,459 | | 12/1980 | Quayle . | |
| 4,389,735 | | 6/1983 | McLaughlin . | |
| 4,404,687 | | 9/1983 | Hager . | |
| 4,476,587 | | 10/1984 | Itoi . | |
| 4,483,469 | | 11/1984 | Arisland . | |
| 4,502,155 | | 3/1985 | Itoi . | |
| 4,563,777 | | 1/1986 | Park . | |
| 4,637,076 | | 1/1987 | Tartt . | |
| 4,658,442 | * | 4/1987 | Tomlinson et al. | 2/94 |
| 4,669,127 | | 6/1987 | Swanson . | |
| 4,689,831 | | 9/1987 | Greenberger et al. . | |
| 4,949,401 | | 8/1990 | Kimsey, Jr. . | |
| 5,002,270 | * | 3/1991 | Shine | 272/119 |
| 5,014,359 | | 5/1991 | Hanson . | |
| 5,123,117 | | 6/1992 | Pendergast . | |
| 5,165,111 | | 11/1992 | Lieberman . | |
| 5,195,187 | * | 3/1993 | Yang | 2/102 |
| 5,247,707 | | 9/1993 | Parker et al. . | |
| 5,278,998 | | 1/1994 | Book . | |
| 5,509,147 | | 4/1996 | Busquets . | |
| 5,584,737 | * | 12/1996 | Luhtala | 2/2.5 |
| 5,784,719 | | 6/1998 | Robinson . | |
| 5,909,802 | | 6/1999 | Puco et al. . | |
| 5,913,409 | | 6/1999 | Test . | |
| 5,987,644 | | 11/1999 | Mengato . | |
| 6,131,199 | | 10/2000 | Bugel et al. . | |
| 6,134,712 | | 10/2000 | Spector . | |
| 6,199,210 | * | 3/2001 | Feldman | 2/69 |

* cited by examiner

*Primary Examiner*—Gloria M. Hale
*Assistant Examiner*—Tejash Patel
(74) *Attorney, Agent, or Firm*—Charles J. Prescott

(57) ABSTRACT

A student's book carrying vest used for carrying larger text and reference books in concealed well-balanced fashion. The vest includes inner and outer flexible generally coextensive sheets having common front, neck and hem edge margins sewn together to define a back panel and right and left front panels. Spaced armholes are formed through the inner and outer sheets and also sewn together in a conventional manner. The inner and outer sheets are also connected together along generally upright elongated intermediate margins between the back panel and the corresponding right and left front panel to define, in combination with the corresponding front and hem edge margins, a back inside pocket and right and left front inside pockets. A closable, elongated pocket forming slit is formed only through the inner sheet and across an upper portion of each of the pockets, each of the pockets and slits sized to fully receive a student's book placed therein and to protectively conceal each such book when the corresponding said slit is closed.

6 Claims, 4 Drawing Sheets

STUDENT'S BOOK CARRYING DEVICE

SCOPE OF INVENTION

This invention relates generally to multi-function upper torso garments and vests, and more particularly to a vest which includes enlarged pockets in all major panels thereof which will receive and concealably carry a student's text books.

PRIOR ART

Multi-function upper torso garments are well known. They are designed to comfortably and efficiently carry or provide carrying capacity for various and sundry items which the wearer would like to have on his immediate possession and readily available.

One such vest for photographers invented by Quayle is disclosed in U.S. Pat. No. 4,241,459. The majority of the pockets provided by this invention are attached to the front surface of the vest and are adaptively configured to receive specific photographic items.

In U.S. Pat. No. 5,123,117, Pendergast teaches a combination backpack and reversible jacket including a hood. The backpack includes a multi-function flap which facilitates being rolled up, forming a pouch or concealing the backpack entirely when not in use.

The sportsman's vest invented by Test in U.S. Pat. No. 5,913,409 includes a plurality of mesh pockets and a plurality of outer pockets with pocket flaps, along with an inner back pocket formed in the back panel thereof. This vest is quite complex and particularly suited for the needs of a sportsman such as a fisherman.

Still another utility vest is disclosed by Parker in U.S. Pat. No. 5,247,707. This utility vest includes a variety of externally attached pockets, loops and pouches and pleated and unpleated pockets disposed about the inner and outer surfaces of the jacket.

Robinson teaches a jacket with a rear compartment in U.S. Pat. No. 5,784,719. This jacket has a large storage compartment located in the upper rear panel of the jacket which eliminates the need for wearing a backpack.

The following additional patents are somewhat further removed from the present invention and teach various combinations of features associated with upper torso jacket and vest-type garments as follows:

| | |
|---|---|
| Busquets 5,509,147 | Len D403,836 |
| McLaughlin 4,389,735 | Park 4,563,777 |
| Puco et al 5,909,802 | Hanson 5,014,359 |
| Greenberger, et al 4,689,831 | Itoi 4,502,155 |
| Itoi 4,476,587 | Book 5,278,998 |
| Arisland 4,483,469 | Spector 6,134,712 |
| Lieberman 5,165,111 | Tarttet, et al. 4,637,076 |
| Kimsey, Jr. 4,949,401 | Mengato 5,987,644 |
| Yellen, et al. 4,068,314 | Hager 4,404,687 |
| Swanson 4,669,127 | Freund 2,248,455 |
| Kirschenbaum 2,304,574 | Buck 2,630,479 |
| Silin 2,970,316 | Bugel, et al. 6,131,199 |

Many students now use a backpack to lug textbooks around campus. This represents an unbalanced load on the torso that can lead to permanent neck, shoulders and torso distortion and nerve damage in extreme cases.

The present invention teaches a unique vest structure adapted to protectively and concealingly receive and hold a student's textbooks in lieu of utilization of a conventional backpack. Each of the book receiving pockets of the present invention are accessible only through inside pocket forming slits formed through an inner panel of the present vest. Closure means such as a zipper or two-part hook and loop VELCRO material or buttons releasably closes the slits after one or more textbooks have been placed into one or more of the inner pockets of the device. Moreover, the present vest will typically be removed for loading and unloading books from one or more of the enlarged inner vest pockets.

BRIEF SUMMARY OF THE INVENTION

This invention is directed to a student's book carrying vest used for carrying larger text and reference books in concealed well-balanced fashion. The vest includes preferably inner and outer flexible generally coextensive sheets having common front, neck and hem edge margins sewn together to define a back panel and right and left front panels. However, a single material sheet folded in half at the lower hem may also be used within the scope of this invention. Spaced armholes are formed through the inner and outer sheets and also sewn together in a conventional manner. The inner and outer sheets are also connected together along generally upright elongated intermediate margins between the back panel and the corresponding right and left front panel to define, in combination with the corresponding front and hem edge margins, a back inside pocket and right and left front inside pockets. A closable, elongated pocket forming slit is formed only through the inner sheet and across an upper portion of each of the pockets, each of the pockets and slits sized to fully receive a student's book placed therein and to protectively conceal each such book when the corresponding said slit is closed.

It is therefore an object of this invention to provide a book-carrying vest for a student which replaces a conventional backpack.

It is still another object of this invention to provide a student book-carrying vest which includes book-receiving pockets only accessible through book-forming slits formed through inner panel of the vest.

It is yet another object of this invention to provide concealable book-receiving pockets of a student's vest which may include a water proof outer sheet which will protect books from being dropped and being affected by the elements while the vest is in use.

It is still yet another object of this invention to provide a student book-carrying vest which is easily removable for loading and unloading large textbooks into and from concealed inner pockets which are only accessible from the inside direction.

Still another object of this invention is to provide a student's book-carrying vest which better balances the distribution of load of heavy textbooks to be both from the front and back of the torso rather than only hanging rearwardly as from a conventional backpack.

In accordance with these and other objects which will become apparent hereinafter, the instant invention will now be described with reference to the accompanying drawings.

DETAILED DESCRIPTION OF THE INVENTION

Figure 1:
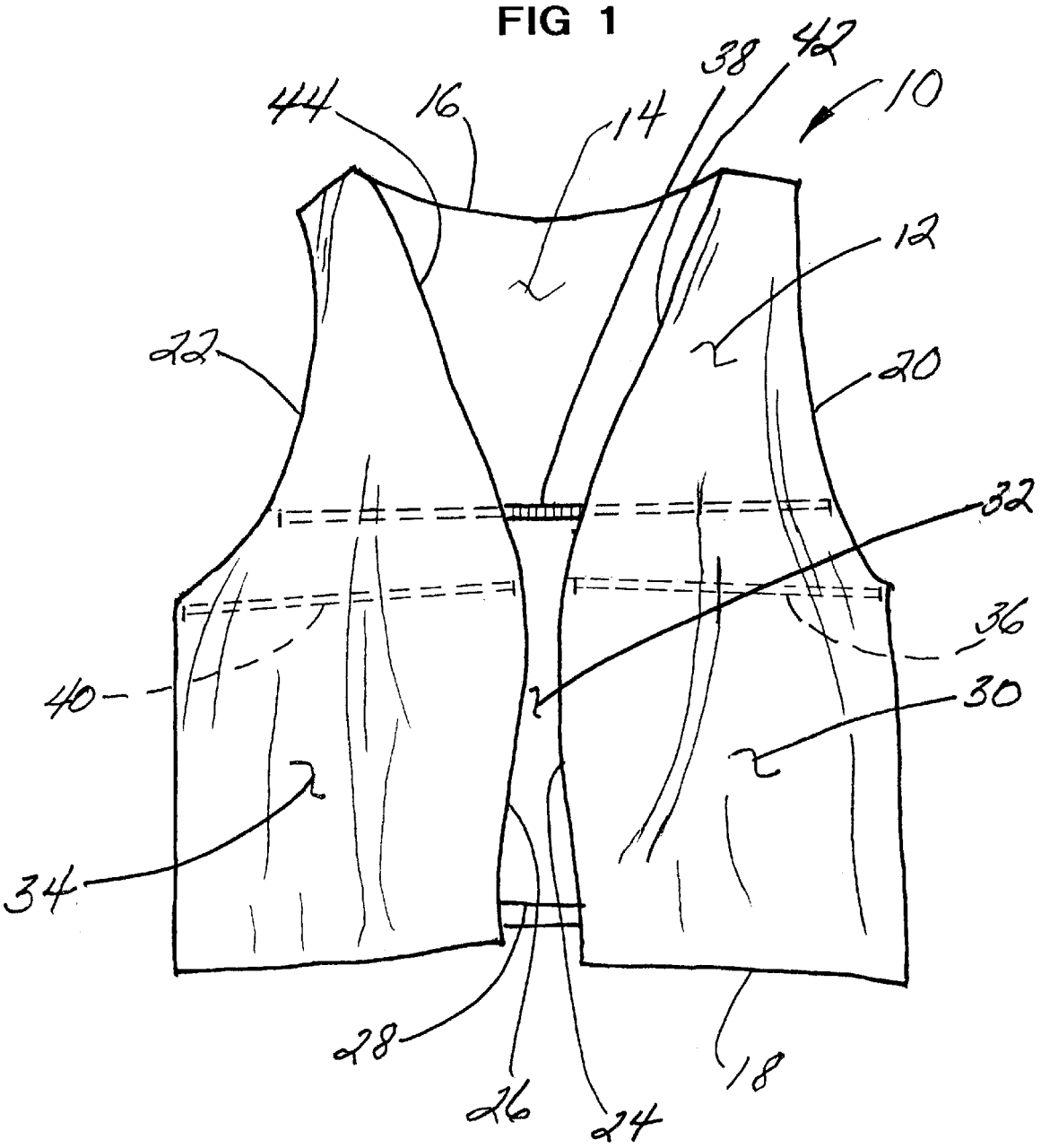
FIG. 1 is a front elevation view of the invention in a natural orientation.
Figure 2:
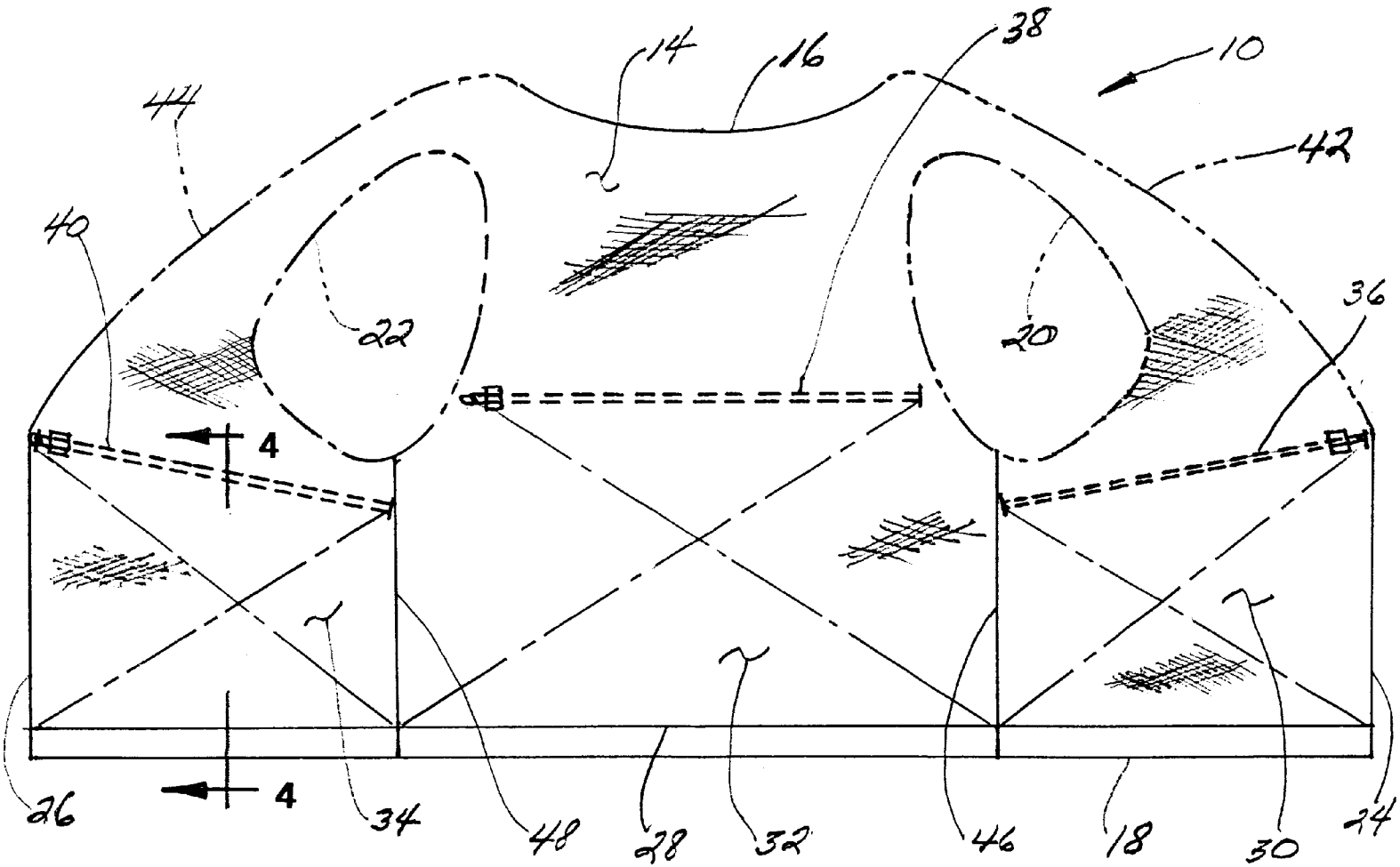
FIG. 2 is a front elevation view of the inner surface of the invention in an opened somewhat in the flat orientation.

Referring now to the drawings, the invention is shown generally at numeral 10 in FIGS. 1 and 2 and is formed of a flexible outer sheet 12 and a flexible inner sheet 14. These outer and inner sheets 12 and 14, respectively, are formed of any suitable flexible sheet material, the outer sheet 12 generally preferred to be of a heavier more durable and even waterproof nature, while the inner sheet 14 is formed of a thinner lining-type material.

The outer and inner sheets 12 and 14, respectively, are sewn together along common edge margins, namely the neck margin 16, the lower hem margin 18, and front margins 24 and 26 which extend as shown in phantom at 42 and 44 up to the neck margin 16. Two armholes 20 and 22 are formed through the outer and inner sheets 12 and 14, respectively, in a conventional manner and are sewn together at the common margins which define the armholes 20 and 22. Note that the arm holes 20 and 22 and edge margins 42 and 44 are shown in phantom in FIG. 2 because the vest 10 will not lay truly flat because of the contoured fitting required of the vest 10 around the shoulder and upper chest areas.

Additional stitched margins 46 and 48 are also utilized to connect the outer and inner sheets 12 and 14, respectively, the stitched margins 46 and 48 extending upwardly from the hem 18 to the armholes 20 and 22, respectively. These intermediate margins 46 and 48 serve, in combination with the lower hem 18 and front edge margins 24 and 26 to define a rear pocket 32 and front pockets 30 and 34 which are continuous in edge-to-edge fashion and horizontally extend between the front margins 24 and 26 as best seen in FIG. 2.

Pocket forming slits 36, 38 and 40 are formed into only the inner sheet 14, the outer sheet 12 being continuous and substantially uninterrupted so that access to each of the corresponding pockets 30, 32 and 34 can only be had through the slits 36, 38 and 40. These slits are made closable, preferably by a zipper, but two-part hook and loop material may also be utilized to serve as a closure means for each of the pockets 30, 32 and 34, respectively.

Figure 3:
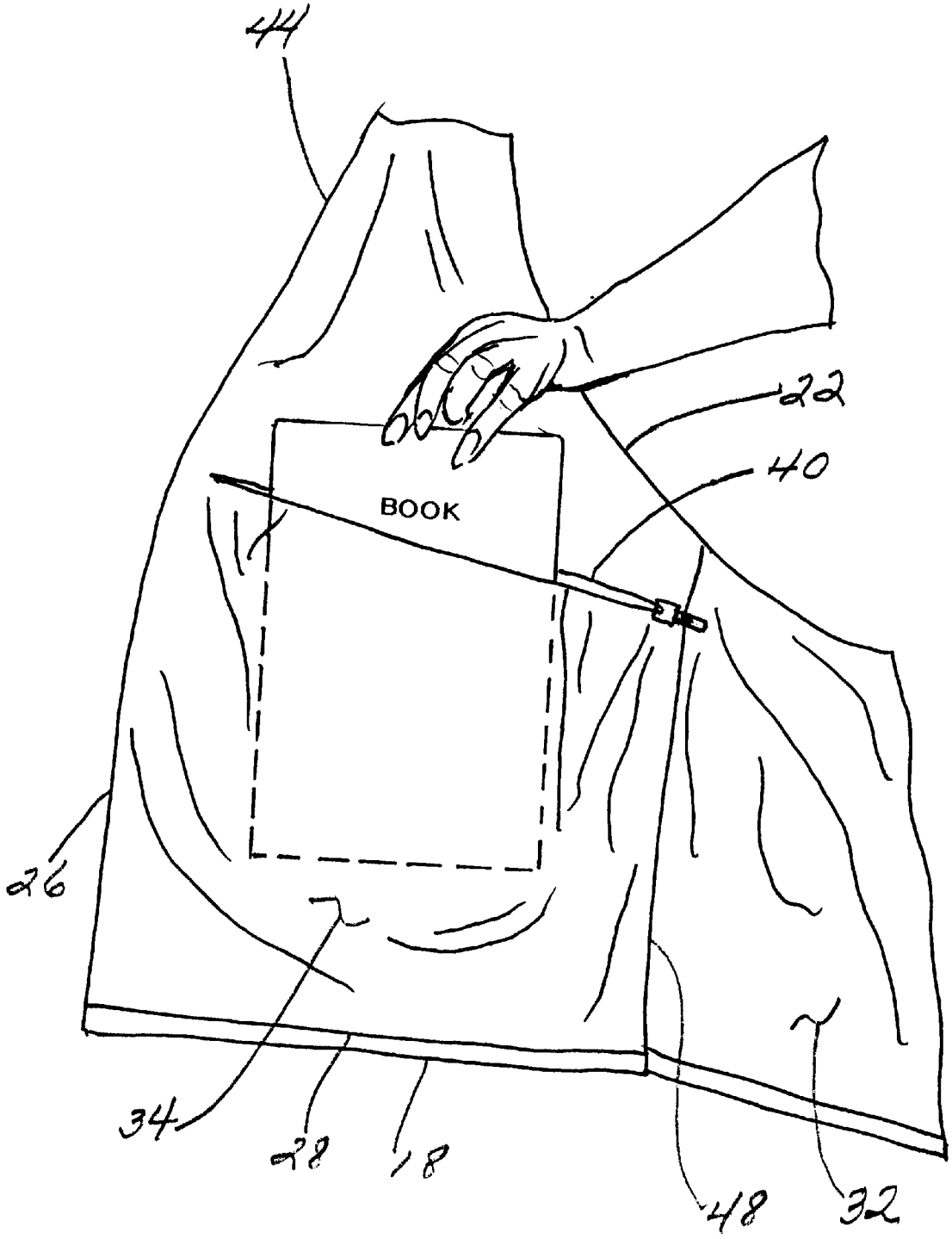
FIG. 3 is a perspective view of the inner right front panel of the invention depicting a book being positioned within a right front pocket formed thereon.

As best seen in FIG. 3, when the corresponding slit, e.g. 40, is opened, an enlarged textbook may be placed into the pocket, e.g. 34 as there depicted. After the textbook is fully within the corresponding pocket, e.g. 34, the corresponding closure means 40 will fully conceal and protect the book when so stored into the desired pocket 30, 32 or 34.

Figure 4:
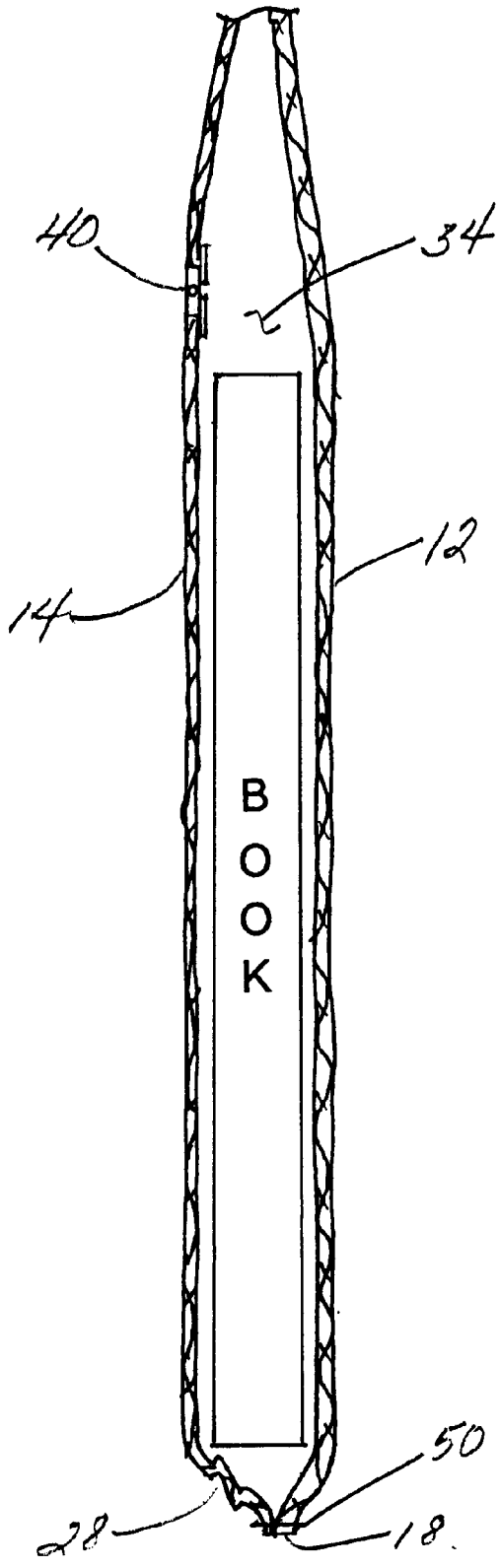
FIG. 4 is a section view in the direction of arrows 4—4 in FIG. 2.

Referring particularly to FIG. 4, the inner sheet 14 includes an expandable fold 28 which is positioned adjacent to, and coextensive with hem 18. This fold 28 expands so that a book placed into the corresponding pocket, e.g. 34, the book will slide downwardly to rest immediately adjacent the hem 18 so as to provide a maximum height of each of the pockets and without material stretching.

In use, it is envisioned that the vest 10 will be removed during loading and unloading of textbooks into one or more of the pockets 30, 32 and 34. By closing each of the zippered slits 36, 38 and 40, the student textbook placed therein are not only restrained from being dropped, but are also protected from the elements, the outer sheet 12 typically of sufficient thickness and texture so as to prevent the textbooks placed within one or more of the pockets from getting wet from inclement weather.

One important aspect of the present invention, when it replaces a conventional backpack utilized by many students to carry books, is to provide a better balance of the heavy textbooks between the front and the back portions of the torso. When all of the book weight is placed into a knapsack positioned against the back of the user, the shoulders, neck and upper torso are under an unbalanced load which typically causes the student to have to hunch or lean forwardly to more effectively counterbalance the out-of-balance book load.

The present invention, by placing heavy books both against the back and front of the torso and hanging from the shoulders provides a much better distribution of load so that stooping or slouching of shoulders does not occur.

Moreover, by connecting the outer and inner panel sheets 12 and 14 only along the edge margins as above described, the margins of the arm holes 20 and 22, and along the upright intermediate margins 46 and 48, an economy of manufacture is afforded, while maximizing the overall size and height and width of each of the pockets 30, 32 and 34 for textbook carrying purposes.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A student's book carrying vest consists of:

inner and outer flexible generally coextensive sheets having common front, neck and lower hem edge margins connected together to define a back panel and right and left front panels, said outer sheet being continuous and substantially uninterrupted;

spaced arm holes formed through said inner and outer sheets;

said inner and outer sheets also connected together along generally upright elongated intermediate margins between said back panel and said right and left front panels, respectively, to define, in combination with corresponding said front and hem edge margins, a back pocket and right and left front pockets;

a single closable elongated pocket-forming slit formed only through said inner sheet and across substantially an entire width of an upper portion of each said pocket;

each of said pockets and slits sized in height and width to fully receive a student's book placed therein and to protectively conceal each such book when a corresponding said slit is closed;

said lower hem of said inner sheet including an expandable fold positioned adjacent to, and generally coextensive with, said lower hem of said inner sheet whereby a book placed into one of said pockets will cause said fold to expand and allow the book to rest directly against and be substantially fully supported in proximity against said lower hem.

2. A student's book carrying vest as set forth in claim 1, wherein:

said slit for each of said front pockets extends somewhat diagonally downwardly from corresponding said front margin to said intermediate margin thereby increasing accessibility into said front pockets;

said slit for said back pocket extending substantially horizontally between and terminating at each end thereof in close proximity to a corresponding said armhole;

said slit for said back pocket positioned higher and further from said lower hem margins than said slits for said front pockets.

3. A student's book carrying vest consists of:

inner and outer flexible generally coextensive sheets having common front, neck and hem edge margins connected together to define a back panel and right and left front panels;

spaced arm holes formed through said inner and outer sheets;

said inner and outer sheets also connected together along a generally upright elongated intermediate margin between said back panel and said right and left front panels, respectively, to define, in combination with corresponding said front and hem edge margins, a back pocket and right and left front pockets;

a single closable elongated pocket-forming slit formed only through said inner sheet and across an upper portion of each of said pockets;

each of said pockets and slits sized in height, width and length, respectively, to fully receive a student's book placed therein and to protectively conceal each such book when a corresponding said slit is closed;

said lower hem of said inner sheet including an expandable fold positioned adjacent to, and generally coextensive with, said lower hem of said inner sheet whereby a book placed into one of said pockets will cause said fold to expand and allow the book to rest directly against and be substantially fully supported in proximity against said lower hem.

4. A student's book carrying vest as set forth in claim 3, wherein:

said slit for each of said front pockets extending somewhat diagonally downwardly from corresponding said front margin to said intermediate margin for increased accessibility into said front pockets;

said slit for said back pocket extending substantially horizontally between and terminating at each end thereof in close proximity to a corresponding said armhole;

said slit for said back pocket positioned higher and further from said lower hem margins than said slits for said front pockets.

5. A student's book carrying vest consists of:

inner and outer flexible sheets having common front, neck and hem edge margins connected together to define a back panel and right and left front panels;

spaced arm holes formed through said inner and outer sheets;

said inner and outer sheets also connected together along generally upright elongated intermediate margins between said back panel and said right and left front panels, respectively, to define, in combination with corresponding said front and hem edge margins, a back pocket and right and left front pockets, respectively;

a single elongated closable generally horizontal pocket-forming slit formed only through said inner sheet and across and defining an entire upper portion of each said pocket;

each of said pockets and slits sized to fully receive a student's book placed therein and to protectively conceal each such book when a corresponding said slit is closed;

said slit for said back pocket extending from and between a mid-portion of each said arm hole;

said back pocket having a height, as determined by the distance between said hem edge margin and corresponding said slits, substantially greater than the height of said front pockets;

said slit for each of said front pockets extending somewhat diagonally downwardly from corresponding said front margin to said intermediate margin for increased accessibility into said front pockets.

6. A student's book carrying vest as set forth in claim 5, wherein:

said lower hem of said inner sheet including an expandable fold positioned adjacent to, and generally coextensive with, said lower hem of said inner sheet whereby a book placed into one of said pockets will cause said fold to expand and allow the book to rest substantially directly against said lower hem.

* * * * *